United States Patent [19]

Hawkins

[11] Patent Number: 4,876,435

[45] Date of Patent: Oct. 24, 1989

[54] SANITARY HAND DRYER

[76] Inventor: Junior F. Hawkins, 3120 W. 16th, Wichita, Kans. 67203

[21] Appl. No.: 143,332

[22] Filed: Jan. 13, 1988

[51] Int. Cl.[4] ..... H05B 1/02

[52] U.S. Cl. ..... 219/364; 219/502; 219/368

[58] Field of Search ..... 219/364, 381, 366, 368, 219/369, 370, 371, 374, 379, 502

[56] References Cited

U.S. PATENT DOCUMENTS

| | | | |
|---|---|---|---|
| 2,516,378 | 7/1950 | Fletcher | 219/366 |
| 2,537,821 | 1/1951 | Fodor | 219/369 |
| 2,606,274 | 8/1952 | Spierer | 219/502 |
| 2,777,934 | 1/1957 | Falkenthal | 219/364 |

FOREIGN PATENT DOCUMENTS

| | | | |
|---|---|---|---|
| 2657164 | 6/1978 | Fed. Rep. of Germany | 219/368 |
| 2719963 | 11/1978 | Fed. Rep. of Germany | 219/364 |
| 1155564 | 5/1958 | France | 219/381 |
| 2333479 | 7/1977 | France | 219/370 |
| 2097254 | 11/1982 | United Kingdom | 219/364 |
| 2136291 | 9/1984 | United Kingdom | 219/370 |

*Primary Examiner*—Teresa J. Walberg
*Attorney, Agent, or Firm*—John W. Carpenter

[57] ABSTRACT

A device which, after washing hands, permits hands to be dried rapidly using hot air directed over, under, and around the hands. The hot air is activated when a hand is placed in position for drying and remains activated until the hand is removed. A touchless switch eliminates the spread of germs by eliminating the need to touch a switch or other object touched by and perhaps contaminated by others who previously used the hand drying device. Furthermore, since the hot air remains activated until the hand is removed, there is no need to retrigger the device since hot air is available as long as it is needed to dry the hands.

5 Claims, 2 Drawing Sheets

FIG. 1
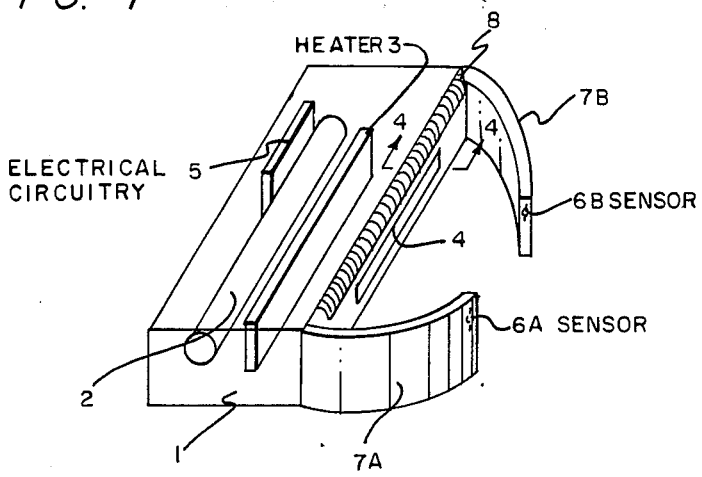
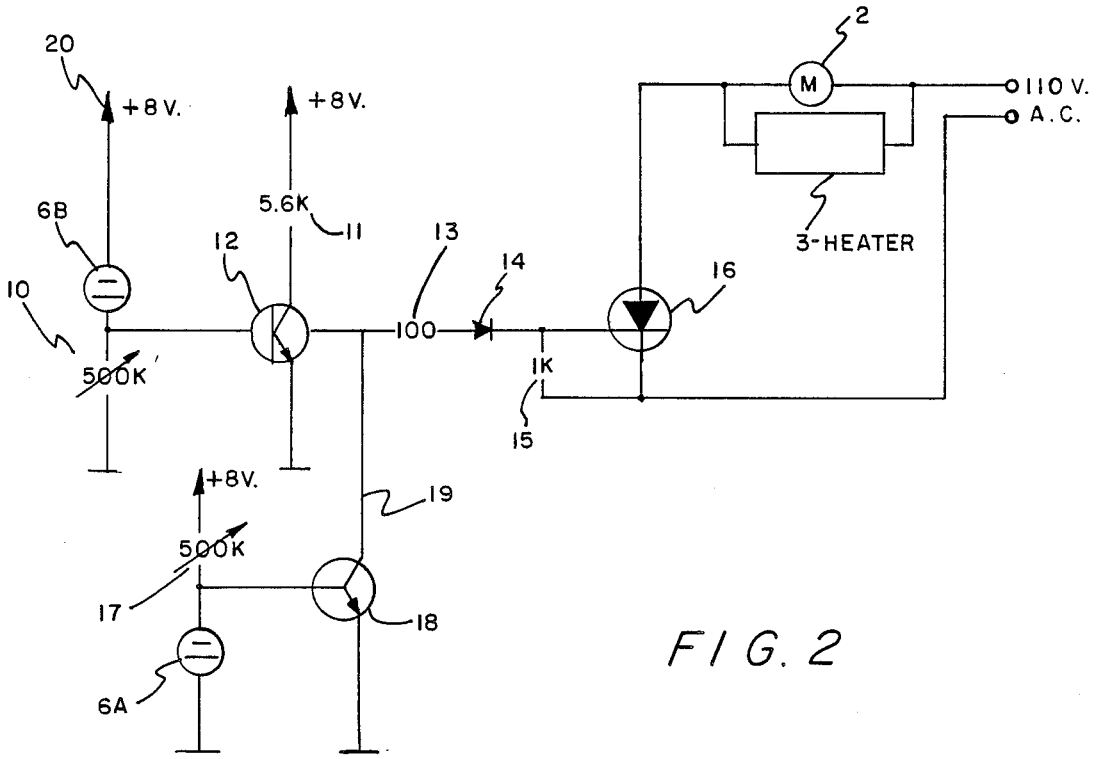
FIG. 2

FIG. 3
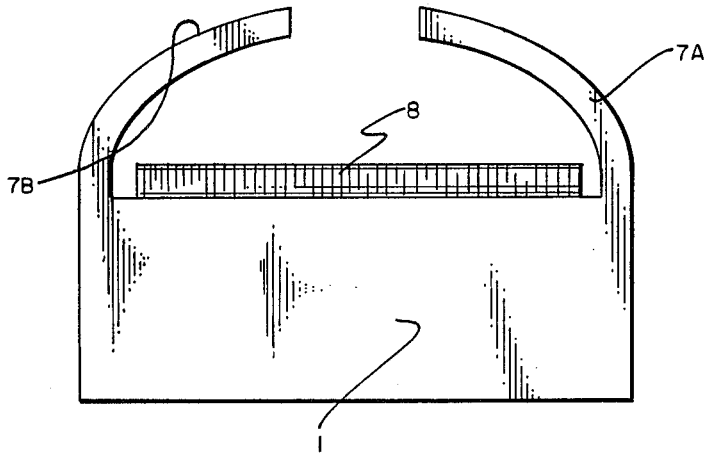
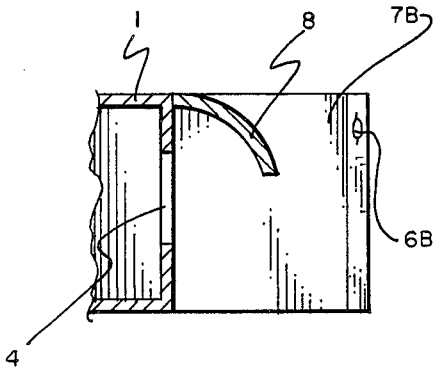
FIG. 4

SANITARY HAND DRYER

BACKGROUND OF THE INVENTION

1. Field of the Invention

This invention relates to a method whereby a person may dry his hands without touching or using a surface previously touched or used by others.

2. Description of the Prior Art

The major disadvantages of conventional hot air dryers are:

(a) they may have to be retriggered before the hands are dried;

(b) in order to trigger the dryer, one must touch a button or other type of on/off switch which may have been contaminated by persons who previously used the dryer and did not wash their hands well; and (c) the time needed to dry the hands may be longer than necessary.

A patentability investigation was conducted and the following U.S. patents were discovered: U.S. Pat. Nos. 2,375,920 to Hewitt; 2,521,769 to Arcularius; 2,714,151 to Becker; and 2,853,592 to Demaret. None of the foregoing prior art patents teach or suggest the particular sanitary hand dryer of this invention. Also, the particular sanitary hand dryer of this invention does not have any of the previously mentioned major disadvantages.

SUMMARY OF THE INVENTION

The sanitary hand dryer device of this invention is designed to be used in restaurants, hospitals, clinics, and situations where cleanliness is a prime concern and/or there is a desire to reduce the spread of germs and diseases as much as may be possible. The device comprises means whereby a person may, after washing his hands, proceed to dry his hands without having to touch a surface which was previously touched by others activating the hand dryer. In addition, the sanitary hand dryer permits the hands to be dried using hot air which also reduces the spread of germs and diseases. The device permits the hands to be dried faster and easier than with current hot air dryers since the air produced by the device is reflected back to a center location in such a manner that a maximum amount of air is permitted to flow over, under, and around the hands. The unique design also means that the air will remain hotter than with current hot air dryers since the air produced is directed towards a specific location rather than being diffused throughout a very large area.

The ability to activate the sanitary hand dryer without touching a switch or other object previously touched by others using the device is made possible by the use of a light-sensitive sensor located on or near the front of the unit. Since the switch doesn't have to be touched, the spread of germs and disease is reduced. Otherwise, the person who activated a manual type switch and doesn't wash at all or doesn't wash well would or could leave germs on the switch and these germs could then be transferred to the next person activating the switch after that person had washed his hands. The sanitary hand dryer device continues to run as long as the hand(s) or wrist(s) is held in front of the activating sensor and there is normal room lighting. It is not necessary to re-trigger the device as is the case with many currently available dryers.

The sanitary hand dryer of this invention more specifically comprises a housing having a structure defining an opening wherethrough warm air can pass. A blower means is disposed in the housing for blowing air; and a heating coil means is also disposed in the housing in proximity to the blower means. An electronic circuitry means is electrically connected to the heating coil means and to the blower means in order to energize the blower means and the heating coil means such that the blower means blows air over the heating coil means to heat the same and discharge warm air through the opening. The electronic circuitry means comprises a light sensor means. A top vane air deflector means is secured to the housing and extends over the opening to deflect warm air passing through said opening. A pair of opposed side vane air deflector means is secured to the housing for deflecting warm air, and the light sensor means is mounted to the side vane air deflector means.

In summary, the sanitary hand dryer device is activated by using a touchless switch operation which triggers the device when hands or wrists are placed in position for drying and the unit remains activated until the hands or wrists are removed from the drying position. A plurality of vanes direct the hot air on and around the hands in such a manner that the hands may be dried quicker than with normal dryers since there is not only more air movement around the hands but the air around the hands will be hotter since the air is not diffused throughout the room. Stated alternatively, the device of this invention permits the hands to be dried in a sanitary manner very rapidly since the air is directed to a specific position which provides not only more air but hotter air around the hands than would normally be available with current units. Furthermore, since the unit is activated by a touchless switch sensor, the spread of germs is reduced from what would be the case if a manual touch-type switch was used.

BRIEF DESCRIPTION OF THE DRAWINGS

FIG. 1 is a perspective view of the sanitary hand dryer of this invention;

FIG. 2 is an electronic schematic of the operating circuit for the sanitary hand dryer;

FIG. 3 is a top plan view of the sanitary hand dryer; and

FIG. 4 is a vertical sectional view of the sanitary hand dryer taken in direction of the arrows and along the plane of line 4—4 in FIG. 1.

DESCRIPTION OF THE PREFERRED EMBODIMENT

Referring in detail now to the drawings, a cabinet 1, which may be a rectangle, square, or other suitable shape, encloses the various parts of the sanitary hand dryer. The cabinet 1 may be constructed from metal, plastic, or other suitable materials and not detract from the operation of the device. A back, side, or other panel of cabinet 1 may be made removable for servicing of the device when necessary.

An opening 4 is made in the front panel of the cabinet 1 in such a manner that air from the electric blower 2 may escape from the cabinet 1 and be forced out against the top vane air deflector 8 and side vane air deflectors 7A and 7B. The opening 4 may be covered with a protective device or constructed in such a manner that it will assist in the deflection of air. The top vane air deflector 8 and the side vane air deflector 7A and 7B are designed in such a manner that when air strikes these vanes, it is deflected to the center of the device in such a manner that a maximum amount of air is produced on and around the hands. In a preferred embodiment of the invention, the deflectors 8, 7A, and 7B are arcuate (or bow shaped), as best illustrated in FIGS. 3 and 4. As shown, deflectors 7A and 7B are rectangular members bent into an arcuate shape. Since the air is not easily diffused throughout the room due to the vanes, the air striking the hands will be hotter than would normally be the case. A blower motor 2 and a heating coil 3 are both disposed in the cabinet 1, preferably such that the blower motor 2 can blow air over the heating coil 3 to heat the air and pass it through the opening 4.

The blower motor 2 may be a standard commercially available blower type motor which will provide sufficient air to dry the hands as may be desired. The heating coil 3 is also a standard available heating coil which will adequately heat the air from the blower motor 2 as it passes over, around, or through the heating coil 3. An electronic circuit 5, illustrated in FIG. 2, activates and de-activates the blower 2 and the heating coil 3. Electronic circuit 5 comprises sensors 6A and 6B which are preferably disposed on the ends of deflectors 7A and 7B as illustrated in FIG. 1. Sensors 6A and 6B may be any suitable sensors such as those disclosed in U.S. Pat. No. 4,329,581 to Helfrich, Jr. et al. which is incorporated herein by reference.

Referring to FIG. 2, the sensor 6B is a light-sensitive sensor and is shown connected to and in communication with eight volts 20, even though other voltages could be used, and to a 500K ohm variable resistor 10 and to a 2n2222 transistor 12. The variable resistor 10 is used to adjust the voltage to transistor 12 in such a manner that it is in a normal on state. While in an on state, transistor 12 will conduct and the voltage available at junction 19 will be zero. If the voltage at junction 19 is zero, then no voltage will be provided to the gate of the silicon controlled rectifier 16 and the blower motor 2 and heating coil 3 will not be activated.

Assuming that the light-sensitive sensor 6A and the 500K ohm variable resistor 16 are in such a state that transistor 18 is off, then when light is prevented from striking the light-sensitive sensor 6B, the voltage at the base of transistor 12 will be reduced to such a level that transistor 12 will be turned off and current will flow from the eight-volt source through 5.6 k ohm resistor 11 through the 100 ohm current limiting resistor 13 and the In914 diode 14 and then across the 1k ohm gate resistor 15 which produces sufficient voltage across the gate resistor 15 to trigger the SCR (silicon controlled rectifier) 16 to an on state. If the SCR 16 is on, then the motor blower 2 and the coil 3 will be activated and the hands may be dried. The unit will remain activated as long as there is sufficient voltage at the gate of SCR 16 and this voltage will be present as long as light is prevented from striking sensor 6B.

If the hand is placed in front of sensor 6B or light is otherwise prevented from striking sensor 6B, the sanitary hand dryer is activated. Since this condition would occur when normal room lighting was removed, sensor 6A has been placed in the circuit to detect this condition. And, when normal room lighting is removed, the sensor 6A will de-activate the sanitary hand dryer in such a manner that the blower 2 and the coil 3 and related circuitry will not function.

The variable resistor 17 is used to adjust the voltage at the base of transistor 18. This voltage is normally such that the transistor 18 is off and therefore has no effect on the operation of the circuit. However, when normal room lighting is removed, voltage is increased to the base of the transistor 18 and transistor 18 will turn on and when this transistor is on, the voltage, if any, from transistor 12 will be shorted through transistor 18 to ground and the SCR 16 gate will have insufficient voltage to be triggered to the on state.

The SCR 16 can obviously be triggered on whenever room lighting is permitted to once again strike sensor 6A. This circuit is indicated as being supplied with eight-volts which controls the standard 110 volt A.C. circuit. These voltages can be changed and still not depart from the circuit operation. The entire circuit could be operated from a standard voltage source and the eight-volts indicated in the schematic can be furnished from any number of standard 110 volt to 8 volt regulated power supplies or converters. An on/off switch, fuse, and other standard electronic components may also e used within and as a part of this circuit to provide for safe operation and to reduce interference with other electrical equipment.

While the above description contains many specificities, these should not be construed as a limitation on the scope of the invention, but rather as an exemplification of one preferred embodiment thereof. Many other variations in size, shape, and material are possible and still remain within the spirit of this invention. The scope of the invention should, therefore, be determined not by the embodiment illustrated but by the appended claims and their legal equivalents.

I claim:

1. A sanitary hand dryer comprising:

a housing having a box-like structure defined by a top, a pair of sides secured to the top, and an upright face secured normally to the top and to the pair of sides, said upright face having a structure defining a longitudinal opening wherethrough warm air can pass;

a blower means disposed in said housing for blowing air;

a heating coil means disposed in said housing in proximity to said blower means;

an electronic circuitry means electrically connected to said heating coil means and to said blower means in order to energize said blower means and said housing coil means such that the blower means blows air over the heating coil means to heat the same and discharge warm air through said longitudinal opening, said electronic circuitry means comprises a light sensor means;

a top vane air deflector means secured to said housing at the securing point where said top secures normally to said face and extending over said longitudinal opening to deflect warm air passing through said longitudinal opening; and a pair of opposed side vane air deflector means secured to said housing at the securing point where said upright front secures normally to said pair of sides for deflecting warm air, and each of said opposed side vane air deflector means has an arcuate shape and terminates in an end and said light sensor means comprises a first light sensor means mounted on the end of one of said side vane air deflector means, and a second light sensor means mounted on the end of the other side vane air deflector means.

2. The sanitary hand dryer of claim 1 wherein said electronic circuitry means comprises a first variable resistor means electrically connected to said first light sensor means, said first light sensor means communicating with a first voltage source means; a first transistor means having a first emitter, a first base, and a first collector, and said first base is electrically connected at a point between said first variable resistor and said first light sensor means, said first emitter being grounded and said first collector communicating with said first voltage source means.

3. The sanitary hand dryer of claim 2 wherein said electronic circuitry means additionally comprises a second transistor means having a second base, a second collector electrically engaged to said first collector and a second emitter being grounded; a second variable resistor means communicating with said first voltage source means and with said second light sensor means, said second base is electrically connected at a point between said second variable resistor and said second light sensor means; a current limiting resistor electrically connected to said first collector; and a first diode electrically connected in series with said current limiting resistor; and a first gate resistor means secured in series with said first diode; and a silicon controlled rectifier means electrically connected across said first gate resistor means.

4. The sanitary hand dryer of claim 3 wherein said blower means electrically connects with said rectifier means and said heating coil means electrically connects across said blower means, and said blower means and said heating coil means and said rectifier means and said first gate resistor means electrically communicate with an alternating current power source.

5. A sanitary hand dryer comprising:

a housing having a structure defining an opening wherethrough warm air can pass;

a blower means disposed in said housing for blowing air;

a heating coil means disposed in said housing in proximity to said blower means;

an electronic circuitry means electrically connected to said heating coil means and to said blower means in order to energize said blower means and said heating coil means such that the blower means blows air over the heating coil means to heat the same and discharge warm air through said opening, said electronic circuitry means comprises a light sensor means;

a top vane air deflector means secured to said housing and extending over said opening to deflect warm air passing through said opening; and a pair of opposed side vane air deflector means secured to said housing for deflecting warm air, said light sensor means is mounted to said site vane air deflector means; said pair of side vane air deflector means is arcuate in shape; and each of said opposed site vane air deflector means has an arcuate shape and terminates in an end;

and said light sensor means comprises a first light sensor means mounted on the end of one of said side vane air deflector means, and a second light sensor means mounted on the end of the other side vane air deflector means, and said electronic circuitry means comprises a first variable resistor means electrically connected to said first light sensor means, said first light sensor means communication with a first voltage source means; a first transistor means having a first emitter, a first base, and a first collector, and said first base is electrically connected at a point between said first variable resistor and said first light sensor means, said first emitter being grounded and said first collector communicating with said first voltage source means.

* * * * *